US005232208A

United States Patent [19]

Braid et al.

[11] Patent Number: 5,232,208

[45] Date of Patent: Aug. 3, 1993

[54] SPRINGS FOR SASH FRAME TENSIONING ARRANGEMENTS

[76] Inventors: Harold K. Braid, The Sheilings Braceborough, Lincolnshire, PE9 4NT; Simon C. Braid, 13, Crowson Way, Deeping, St. James, Lincolnshire, both of England

[21] Appl. No.: 875,233

[22] Filed: Apr. 28, 1992

[30] Foreign Application Priority Data

May 15, 1991 [GB] United Kingdom ..... 9110523
Nov. 1, 1991 [GB] United Kingdom ..... 9123248
Mar. 30, 1992 [GB] United Kingdom ..... 9206896

[51] Int. Cl.[5] ..... E16F 1/10; F05D 13/00

[52] U.S. Cl. ..... 267/156; 16/197; 16/DIG. 16

[58] Field of Search ..... 267/156, 272; 16/197, 16/198, DIG. 16; 49/445; 248/162.1; 403/329

[56] References Cited

U.S. PATENT DOCUMENTS 2,609,193 9/1952 Foster ..... 267/1
3,358,403 12/1967 Dinsmore ..... 49/445
3,452,480 7/1969 Foster ..... 49/445
3,475,865 11/1969 Arnes ..... 49/445
3,869,754 3/1975 Foster ..... 16/197
3,992,751 11/1976 Foster et al. ..... 16/197
4,227,345 10/1980 Durham, Jr. ..... 49/445
4,935,987 6/1990 Sterner, Jr. ..... 16/197
4,953,258 9/1990 Mennuto ..... 16/197
4,961,247 10/1990 Leitzel et al. ..... 16/197
5,157,808 10/1992 Sterner, Jr. ..... 267/156

*Primary Examiner*—Robert J. Oberleitner
*Assistant Examiner*—Chris Schwartz
*Attorney, Agent, or Firm*—Steven H. Bazerman

[57] ABSTRACT

A coiled ribbon spring comprising a coiled ribbon spring body and, at a free end thereof, a tongue portion having first engagement means for operative connection to an object to be tensioned, said tongue having at a location between said first engagement means and the coiled ribbon spring body, second engagement means co-operable with first engagement means provided on another coiled ribbon spring. Also an assembly of such springs disposed one above the other working in concert e.g. in pairs.

12 Claims, 2 Drawing Sheets

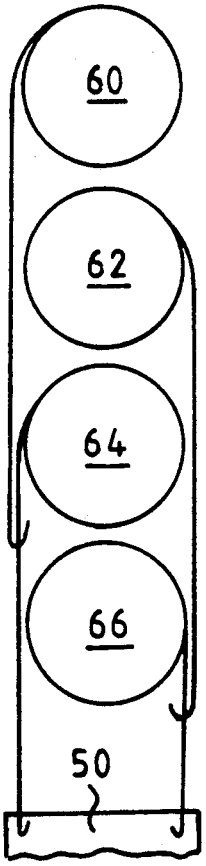
FIG.3
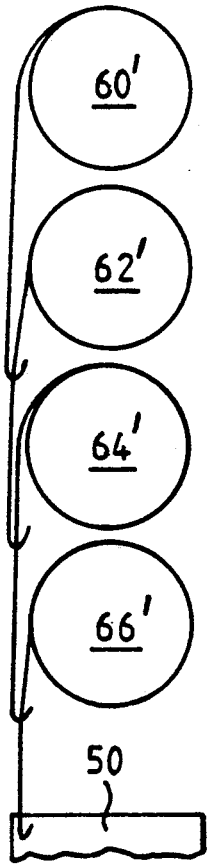
FIG.3A
FIG.4
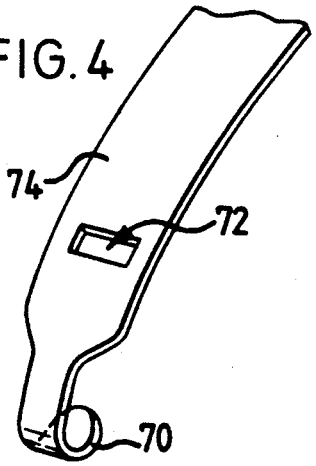
FIG.5
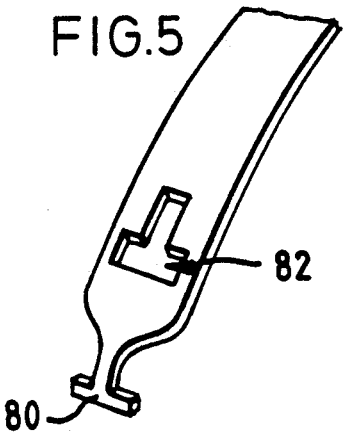
FIG.6
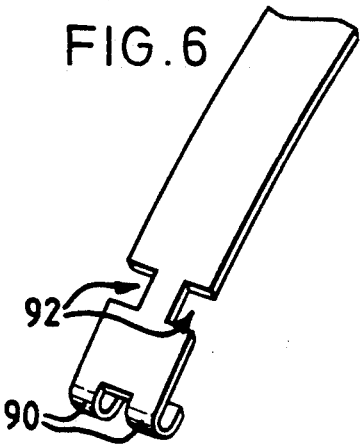

SPRINGS FOR SASH FRAME TENSIONING ARRANGEMENTS

FIELD OF THE INVENTION

The invention relates to springs for sash frame tensioning arrangements and particularly, though not exclusively, for sash window frames of the kind which incorporate a coiled ribbon spring made of spring steel or some other suitable spring material. These springs are similar in appearance to clock springs but generally have an internal end which is not fixed (as it is in a clock spring). Instead the spring is mounted so as to be able to rotate as an outside free end, or tongue, is pulled away so uncoiling the spring under tension. Such rotating springs are often known as "constant force" springs.

BACKGROUND OF THE INVENTION

In the known construction of modern sash frames the frame members, especially the side portions, are usually made from aluminium or plastics and of channel section. A coiled ribbon spring is mounted in each side channel at each side of the window sash and having its tongue operatively connected to the sliding sash frame. Thus, as the window is moved from a closed to an open position the springs are unwound under tension to support the sliding sash frame in any desired open position. Such coiled ribbon springs are compact and simple in operation.

A problem arises where the sliding sash is a heavy one, for example where double-glazed or especially thick glass is used. Because higher rated springs are often more bulky, it has been a practice to utilise multiple spring arrangements with two springs working in unison at each channel location to obtain the desired higher spring rating. In such arrangements, the springs are mounted one above the other; sometimes mounted for rotation in the same directional sense but preferably in opposite senses so that tongues of respective springs can be operatively connected at spaced-apart positions of the sliding sash frame. This arrangement makes for smoother running.

It has been proposed to provide four springs at each location but it is a problem with such multiple spring arrangements that they are difficult to assemble, since a tongue of each spring has to be engaged with the sliding frame element, and if the springs have tongues of the same length then one or more of the springs is under tension during assembly (and also after assembly in all positions of the sliding window sash, i.e. even when the sash is closed). To avoid the latter problem, though not the former, springs with extended tongues (when untensioned) can be used. It is obviously desirable that the number of different types of spring used in a particular construction should be kept to a minimum. There is also a problem that space is at a premium in such channels and the overlapping of tongues of upper springs alongside lower springs increases assembly problems and the likelihood of friction, and jamming. The invention seeks to provide a means of mitigating or obviating such problems.

SUMMARY OF THE INVENTION

The present invention provides in its broadest aspect a coiled ribbon spring comprising a coiled ribbon spring body and, at a free end thereof, a tongue portion having first engagement means for operative connection to an object to be tensioned, said tongue having at a location between said first engagement means and the coiled ribbon spring body, second engagement means cooperable with first engagement means provided on another coiled ribbon spring.

It will be readily appreciated that the coiled ribbon spring of the invention enables said other coiled ribbon spring to be operatively connected to said object to be tensioned indirectly via the agency of the tongue of the coiled ribbon spring according to the invention. This minimises the overlapping of tongues and also minimises the extent to which springs with extended tongues need to be provided in order to overcome the above problems.

Preferably, said first engagement means comprises a hook formation said formation being hooked in a sense the same as the normal curvature of the coiled ribbon spring, and said second engagement means comprises an aperture into which a complementary hook formation of said other spring may be engageably received.

Desirably said hook formation is provided by a hooked end of reduced breadth of the tongue of the coiled ribbon spring according to the invention and said aperture is a slot in the tongue sufficiently wide to accept the hooked end of said other spring.

Although it will be seen that in the coiled ribbon spring according to the invention the hooked end does not have to be such as to engage with its own slot since these will never be engaged in practice, nevertheless for conformity and versatility, the slot and hooked end should be of such dimensions that a second coiled ribbon spring according to the invention may be utilised as said other coiled ribbon spring.

Desirably, the tongue of the coiled ribbon spring according to the invention is of a length from the point where it leaves the coil (at rest) equal to between 1.5 and 2.0 diameters of the coiled ribbon spring (when at rest).

Preferably, the second engagement means is spaced from the first engagement means by a distance equal to approximately 1.0 diameter of the coiled ribbon spring (when at rest).

In another preferred coiled ribbon spring according to the invention, the first engagement means comprises a 'T'-shaped or keyhole-shaped end portion of the coiled ribbon spring, this being conveniently formed by removing a portion of the spring from each side edge of the spring to form the 'T', the second engagement means being provided by an apertured portion of the tongue, said apertured portion being of generally 'T'-shape or keyhole-shape and dimensioned to receive first engagement means of a second coiled ribbon spring.

The first engagement means may alternatively comprise a pair of hooked portions laterally spaced apart at a free end portion of the coiled ribbon spring, the second engagement means being provided by a portion of the spring of reduced width or one or more indents or apertures cooperable with first engagement means of a second coiled ribbon spring, according to the invention.

The invention provides in another of its aspects a coiled ribbon spring assembly comprising four coiled ribbon springs according to the broadest aspect of the invention and operatively mounted on a support wherein three of the coiled ribbon springs are of the kind described in the last preceding paragraph, and one of the springs is provided with a tongue of a length approximately equal to 3.5 diameters of the coiled ribbon spring (when at rest) and having said second engagement means spaced from said first engagement means by approximately three diameters of the coiled ribbon spring (when at rest).

In this assembly, the four springs involved will typically be mounted with two of the identical springs lowest and rotating in the same sense with the tongue of the second lower-most spring engaged with the tongue of the lower-most spring, the latter being attached to the object to be tensioned (i.e. a portion of the sash frame). The third lower-most spring will be the spring having the elongate tongue and this will be engaged with the object to be tensioned and passing alongside the two lower-most springs, the upper-most spring being of the same dimensions as the two lower-most and having its tongue engaged with the tongue of the third lower-most spring. The two upper-most springs are arranged to rotate in the same sense but opposite to that of the two lower-most springs. It will be readily apparent that other arrangements are possible whereby adjacent springs rotate in opposite senses. In such an arrangement the tongues of three of the springs would typically be of approximately 1.5 spring diameters with a spacing of approximately 2 diameters between first and second engagement means, and the tongue of the fourth spring would be approximately 1.5 spring diameters with a spacing of approximately 1 spring diameter between the first and second engagement means.

Preferably the object to be tensioned (i.e. the portion of the sash frame) to which the tongues are to be operatively connected has engagement means which will receive the first engagement means of certain ones of the springs.

BRIEF DESCRIPTION OF THE DRAWINGS

Embodiments of the invention will now be described by way of example only and with reference to accompanying drawings in which:

FIG. 3 is a schematic view of a spring arrangement alternative to that of FIG. 1, incorporating the invention.

FIG. 3A is a schematic view of a spring arrangement alternative to those of FIGS. 1 and 3, incorporating the invention, FIG. 4 is a schematic view of an end portion of a first coiled ribbon spring according to the invention.

FIG. 5 is a schematic view of an end portion of a second coiled ribbon spring according to the invention.

FIG. 6 is a schematic view of an end portion of a third coiled ribbon spring according to the invention.

DESCRIPTION OF THE PREFERRED EMBODIMENTS

Figure 1:
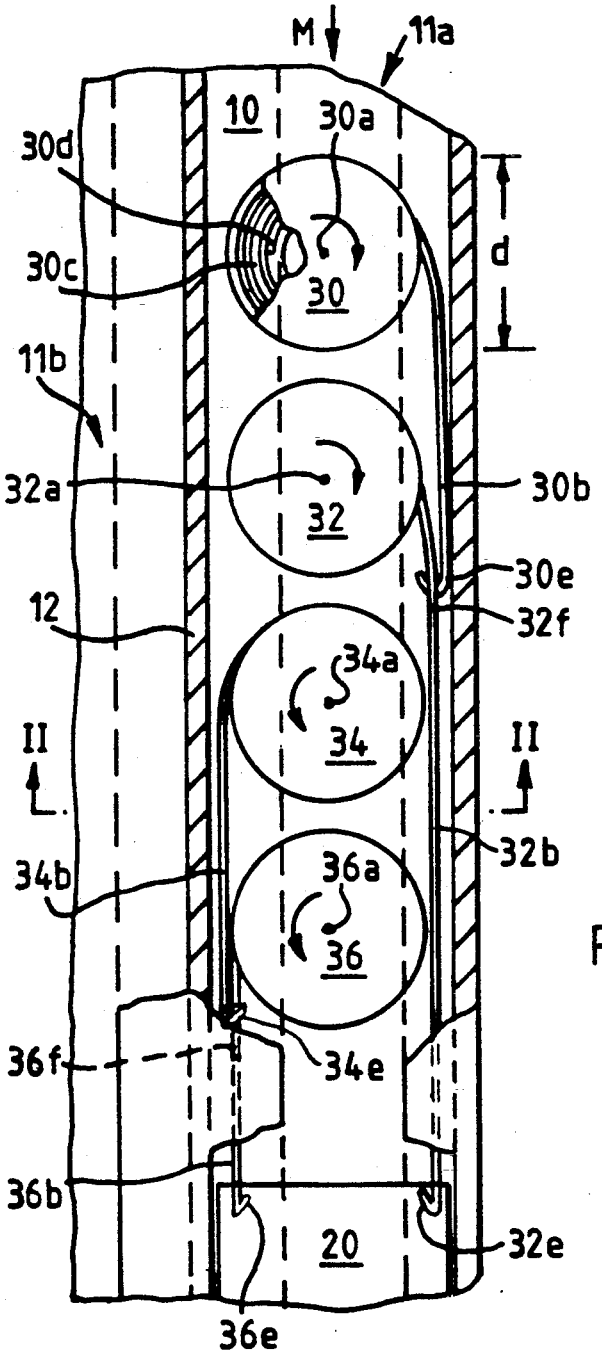
FIG. 1 is a schematic elevational view in a direction parallel with the plane of the sash of a vertical side frame portion of a sash window frame arrangement incorporating the invention.

FIG. 1 shows a portion of one vertical side frame of a sash window frame assembly comprising a frame portion 10 defining a pair of vertical channels 11*a* and 11*b* (shown only in part), support portions 20 (only one of which is shown) slidably movable in one of said channels 11*a* and 11*b* respectively and operatively supporting, in use, a movable frame mounting panes of glass (not shown). The weight of the movable frame is counterbalanced by eight coiled ribbon springs (four at each side of the frame—only four are shown in FIG. 1). The four springs shown in FIG. 1, springs 30, 32, 34 and 36 are mounted to rotate about pivots 30*a*, 32*a*, 34*a* and 36*a* respectively. Each has a coiled ribbon body portion and a free end terminating in a tongue 30*b*, 32*b*, 34*b* and 36*b* respectively. Three of the springs 30, 34, 36 are identical in size and in the length of their tongues. Each has a tongue about 1.5 times the diameter 'd' of a coiled ribbon spring body portion (all are of approximately the same diameter) and the springs are each mounted on a respective reel (see FIG. 2) for rotation about their respective axes. A portion of the reel for spring 30 is shown cut-away in FIG. 1 to reveal a portion of the ribbon body portion 30*c* of that spring and the free end 30*d* thereof. The spring 32 is generally similar to the other springs except that it has a tongue about 3.5 times the diameter 'd' of a coiled ribbon spring body portion.

The tongues of spring 34 and 36 are provided at their ends with engagement means each provided by a narrowed region of hook shape 34*e*, 36*e*. Spaced from that first engagement means on the tongue of spring 36 is a slot 36*f* which provides second engagement means for the reception of first engagement means 34*e* of spring 34. The distance between the first and second engagement means on spring 36 is approximately equal to one coiled ribbon spring diameter 'd'. The hooked end 36*e* of spring 36 is engaged in the support member 20 which is provided with a slotted recess to engage the same.

Similarly, the tongues of spring 30 and 32 are provided at their ends with first engagement means 30*e*, 32*e*. Engagement means 32*e* of spring 32 are engaged in a recess in the support member 20 and the tongue of that spring is also provided with second engagement means comprising a slot 32*f* which receives the hooked end 30*e* of spring 30.

Springs 30 and 32 act in concert by virtue of their engagement and rotate in the same sense, as do springs 34 and 36, which rotate in the same sense but opposite to that of springs 30 and 32.

In fact springs 30 and 34 also have second engagement means (springs 30, 34 and 36 being identical) but the second engagement means of springs 30 and 34 are not, in the arrangement shown, used.

It will be seen that insertion of the springs into their position, upon assembly of the arrangement is quite simple. Spring 36 is slid into the channel 11*a* and moved up to the support member 20 until its hooked end 36*e* is received in the corresponding receptacle. Pivot 36 is then established by means of a screw (not shown) and spring 34 is then slid into the channel 11*a* with the hooked end 34*e* being threaded between spring 36 and a wall 12 of the channel 11*a*. It will be seen that the hooked end 34*e* will, by virtue of the springiness of the tongue 34*b*, locate in slot 36*f* whereupon the pivot 34*a* of spring 34 can also be established by means of a screw (not shown). Springs 32 and 30 are then inserted in like manner. It will be found in practice that the arrangement also enables the assembly to be taken to pieces should this be required e.g. for the replacement of a damaged spring.

The arrangement of springs shown in FIG. 1 is only one example of how the invention may be employed advantageously. FIG. 3 shows a schematic arrangement of springs which is in an alternative to the arrangement shown in FIG. 1. In FIG. 3 there are three springs 60, 62 and 64 having tongues of the same length and fourth spring 66 which has a tongue of shorter length. In that arrangement the tongues of the lower-most spring 66 and the second lower-most spring 64 are attached to the support member 50. The tongue length is approximately 2.5 times 'd' in respect of the three identical springs and approximately 1.5 times 'd' in respect of spring No.66. The spacings between the first and second engagement means for springs 60, 62 and 64 is approximately 2.0 times 'd' and for spring 66 approximately 1.0 times 'd' the second engagement means of springs 62 and 60 are not used in the arrangement shown in FIG. 3.

The arrangement shown in FIG. 3A comprises four identical springs 60'; 62'; 64'; and 66'; each having the same tongue length and each identical to spring 36 shown in FIG. 1. All the springs rotate in the same sense and the first engagement means (hook) of the uppermost spring engages the second engagement means (slot) of the spring beneath it and so on.

The thickness of the coiled ribbon springs in FIGS. 4–6 has been emphasized relative to their width.

FIG. 4 shows a free end portion of a coiled spring of the type used in the embodiment of FIGS. 1 to 3 and 3A. The first engagement means comprises a hooked end 70, of narrowed width. The second engagement means comprises a lateral slot 72 cooperable with a hooked end first engagement means of a second coiled ribbon spring (not shown but either having an identical free end portion to that shown in FIG. 4 or being identical thereto). The spring end shown in FIG. 4 has the advantage that it is easy to engage two similar springs together, the hook of one spring riding along the back 74 of the first spring until engaged in slot 72.

Figure 2:
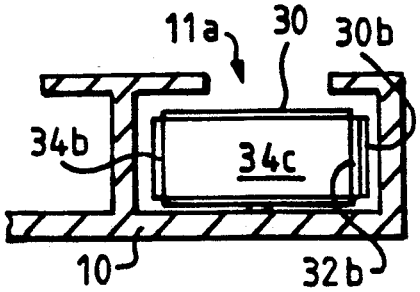
FIG. 2 is a sectional view on line II—II of FIG. 1.

FIG. 5 shows an alternative end formation for a coiled ribbon spring of a type capable of being used in the arrangement of FIGS. 1–3, and comprises first engagement means 80 provided by a 'T'-shaped end formation (which is not hooked), the second engagement means 82 comprising a 'T'-shaped slot, larger, but shaped similarly to the first engagement means. It will be readily apparent how two springs of the type shown in FIG. 5 may be engaged with each other.

FIG. 6 shows a further end formation wherein the first engagement means comprises two laterally spaced hook formations 90, and the second engagement means comprises a pair of indents 92.

It will be readily apparent that any suitable engagement means will be appropriate in performing the invention and not only the hook and slot arrangement described. The spring according to the invention may be used in assemblies of two, three, four or more within the limitations of space available according to need, with more than two springs working in concert if required.

We claim:

1. A coil spring counterbalance assembly for counterbalancing a vertically displaceable sash within a window frame encasement structure, said coil spring counterbalance assembly comprising body and, at a free end thereof, a tongue portion having first connecting means for fastening the first coiled ribbon spring body to an object to be tensioned, said tongue having at a location spaced from said first connecting means between said first connecting means and the coiled ribbon spring body, second connecting means of such structure that it fastens with a first connecting means on a second coiled ribbon spring body, said first connecting means in the second coiled ribbon spring body comprising a tongue and being of the same construction as said first connecting means on said first coiled ribbon spring body.

2. A coil spring counterbalance assembly comprising four coiled ribbon spring bodies in accordance with claim 1 in which three of the coiled ribbon spring bodies have tongues of the same length and the fourth coiled ribbon spring body has an elongated tongue.

3. A coil spring counterbalance assembly comprising four coiled ribbon springs in accordance with claim 2 in which the three identical springs are each of a length from the point where the coil at rest is equal to between 1.5 and 2.0 diameters of the coiled ribbon spring body when at rest and the fourth coiled ribbon spring is provided with a tongue of a length approximately equal to 3.5 diameters of the coiled ribbon spring.

4. A coil spring counterbalance assembly comprising four coiled ribbon springs in accordance with claim 3 in which in the fourth coiled ribbon spring body, said second connecting means are spaced from said first connecting means by approximately 3.0 diameters of the coiled ribbon spring body.

5. A coil spring counterbalance assembly in accordance with claim 2 in which the four coiled ribbon spring bodies are mounted one above the other with the lower-most two springs disposed so as to be rotatable in the same sense and the upper-most two springs are disposed so as to be rotatable in the same sense but opposite to that of the lower-most two springs.

6. A coil spring counterbalance assembly in accordance with claim 1 in which said first connecting means on the first and second coiled ribbon spring body comprises a hook means, and said second connecting means on said first coiled ribbon spring body comprises an aperture in its tongue so shaped that the hook means of said second coiled ribbon spring body is engageably received therein.

7. A coil spring counterbalance assembly in accordance with claim 6 in which said hook means in said first and second coiled ribbon spring body is formed by a U-shape in the end of the tongue furthest from the coiled ribbon spring body, the aperture in said first coiled ribbon spring body is a slot in the tongue of said first coiled ribbon spring body sufficiently wide to accept the corresponding U-shaped end of said tongue of said second coiled ribbon spring body.

8. A coil spring counterbalance assembly in accordance with claim 1 in which the first and second coiled spring bodies are of the same construction and are interconnected by the second connecting means of the first coil ribbon spring body and the first connecting means of the second coil ribbon spring body.

9. A coil spring counterbalance assembly in accordance with claim 1 in which said first connecting means in said first and second coiled ribbon spring body comprises a tongue portion of reduced breadth and said second connecting means in said first coiled ribbon spring body comprises a slot in the tongue of said first coiled ribbon spring body so shaped that the first connecting means of said second coiled ribbon spring body may be connected thereto.

10. A coil spring counterbalance assembly in accordance with claim 1 which the tongue of the first coiled ribbon spring body is of a length from the point where it leaves the coil equal to between 1.5 and 2.0 diameters of the coiled ribbon spring body.

11. A coil spring counterbalance assembly as claimed in claim 1 in which the second connecting means of said first coiled ribbon spring is spaced from the first connecting mens by a distance equal to approximately 1.0 diameter of the coiled ribbon spring body.

12. A coil spring counterbalance assembly comprising four identical coiled ribbon spring bodies in accordance with claim 1, each spring engaging the one beneath it except for the lowermost, all the springs being mounted for rotation in the same sense.

* * * * *

UNITED STATES PATENT AND TRADEMARK OFFICE

CERTIFICATE OF CORRECTION

PATENT NO. : 5,232,208

DATED : August 3, 1993

INVENTOR(S) : Harold K. Braid and Simon C. Braid

It is certified that error appears in the above-identified patent and that said Letters Patent is hereby corrected as shown below: Column 5, line 54:

Claim 1, line 4, "comprising body" should read -- comprising a first coiled ribbon spring body --

Signed and Sealed this

Twenty-eighth Day of December, 1993

*Attest:*

BRUCE LEHMAN

*Attesting Officer*

*Commissioner of Patents and Trademarks*